US011024449B2

(12) United States Patent
Bharadwaj et al.

(10) Patent No.: US 11,024,449 B2
(45) Date of Patent: Jun. 1, 2021

(54) MULTIPOLE ELASTOMERIC MAGNET WITH MAGNETIC-FIELD SHUNT

(71) Applicant: Apple Inc., Cupertino, CA (US)

(72) Inventors: Shravan Bharadwaj, San Jose, CA (US); David S. Herman, San Francisco, CA (US); Rafael L. Dionello, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 327 days.

(21) Appl. No.: 15/925,621

(22) Filed: Mar. 19, 2018

(65) Prior Publication Data

US 2018/0350491 A1 Dec. 6, 2018

Related U.S. Application Data

(60) Provisional application No. 62/515,904, filed on Jun. 6, 2017.

(51) Int. Cl.
*H01F 1/00* (2006.01)
*H01F 1/153* (2006.01)
(Continued)

(52) U.S. Cl.
CPC ..... *H01F 1/15375* (2013.01); *H01F 1/0533* (2013.01); *H01F 1/083* (2013.01);
(Continued)

(58) Field of Classification Search
CPC . H01F 1/153; H01F 3/12; H01F 7/021; H01F 7/0215; H01F 3/08
(Continued)

(56) References Cited

U.S. PATENT DOCUMENTS 3,488,565 A * 1/1970 Teltscher ..... G04B 47/00 361/300
4,543,551 A * 9/1985 Petersen ..... H01F 7/0247 118/640
(Continued)

FOREIGN PATENT DOCUMENTS

CN 1400613 A 3/2003
CN 101522317 A 9/2009

OTHER PUBLICATIONS

Silicones With Magnetic Properties, Wacker Chemie AG, 2015, 3 pages.

*Primary Examiner* — Shawki S Ismail
*Assistant Examiner* — Lisa N Homza
(74) *Attorney, Agent, or Firm* — Treyz Law Group, P.C.; G. Victor Treyz; David K. Cole

(57) ABSTRACT

A multipole permanent magnet may be provided with a magnetic-field shunt. The multipole permanent magnet may be formed from compression-molded magnetic particles such as magnetically anisotropic rare-earth particles in an elastomeric polymer. The magnetic-field shunt may be formed from magnetic members in a polymer binder that are separated by gaps to allow the shunt to flex or from magnetic particles in a polymer binder. The magnetic particles in the polymer binder may be ferrite particles or other magnetic particles. The polymer binder may be formed from an elastomeric material and may be integral with the elastomeric polymer of the multipole permanent magnet or separated from the elastomeric polymer of the multipole permanent magnet by a polymer separator layer. Conductive particles may be formed in polymer such as the elastomeric polymer with the magnetic particles. The conductive particles may be configured to form electrical connector contacts and other signal paths.

20 Claims, 7 Drawing Sheets

(51) Int. Cl.
*H01F 7/02* (2006.01)
*H01F 3/12* (2006.01)
*H01F 1/053* (2006.01)
*H01F 1/08* (2006.01)

(52) U.S. Cl.
CPC ..... *H01F 3/12* (2013.01); *H01F 7/021* (2013.01); *H01F 7/0215* (2013.01)

(58) Field of Classification Search
USPC ..... 335/296
See application file for complete search history.

(56) References Cited

U.S. PATENT DOCUMENTS 4,838,347 A 6/1989 Dentini et al.
4,941,236 A * 7/1990 Sherman ..... A44C 5/2071 24/265 WS
5,637,402 A 6/1997 Gay
5,643,686 A 7/1997 Isshiki et al.
6,126,588 A 10/2000 Flamant et al.
6,411,191 B1 * 6/2002 Shea ..... H01C 7/13 338/22 R
6,652,958 B2 11/2003 Tobita
6,660,566 B2 12/2003 Masayuki
7,347,955 B2 3/2008 Tobita et al.
8,957,751 B2 * 2/2015 Fullerton ..... H05K 9/00 335/296
8,997,318 B2 * 4/2015 Nicolas ..... A44C 5/04 24/265 WS
9,894,964 B2 * 2/2018 Perkins ..... G04B 37/1486
2002/0050175 A1 * 5/2002 Feller ..... G01F 1/584 73/861.12
2005/0149002 A1 * 7/2005 Wang ..... A61L 29/18 606/1
2005/0216075 A1 * 9/2005 Wang ..... A61L 29/18 623/1.15
2006/0102871 A1 * 5/2006 Wang ..... A61L 27/446 252/62.51 R
2006/0249705 A1 * 11/2006 Wang ..... A61L 29/18 252/62.51 C
2006/0292395 A1 * 12/2006 Mori ..... C22C 38/005 428/692.1
2007/0001292 A1 1/2007 Ohta et al.
2007/0135913 A1 * 6/2007 Moaddeb ..... A61F 2/2448 623/2.37
2008/0152953 A1 * 6/2008 Lim ..... G11C 11/15 428/827
2008/0198512 A1 * 8/2008 Mukai ..... G11B 5/7325 360/313
2009/0073599 A1 * 3/2009 Nemoto ..... G11B 5/65 360/77.02
2009/0080105 A1 * 3/2009 Takashita ..... G11B 5/02 360/75
2009/0080120 A1 * 3/2009 Funayama ..... G11B 5/02 360/319
2010/0072994 A1 * 3/2010 Lee ..... G01N 24/08 324/307
2011/0009690 A1 * 1/2011 Belhe ..... A61F 5/0076 600/37
2011/0273253 A1 * 11/2011 Fullerton ..... H01F 7/0247 335/306
2012/0091832 A1 * 4/2012 Soderberg ..... C08J 3/00 310/44
2012/0143039 A1 * 6/2012 Hartwig ..... A61K 9/0009 600/409
2012/0146752 A1 6/2012 Fullerton et al.
2012/0242440 A1 * 9/2012 Fullerton ..... E05C 19/16 335/306
2014/0194806 A1 * 7/2014 Belhe ..... A61F 5/0076 604/8
2015/0091680 A1 4/2015 Gery
2016/0003269 A1 * 1/2016 Russell-Clarke .... A44B 11/008 24/303
2016/0029762 A1 * 2/2016 James, Jr. ..... A45C 13/02 190/109
2016/0051806 A1 * 2/2016 Goldsmith ..... A61N 1/00 604/21
2016/0297602 A1 * 10/2016 Hutchins ..... A45C 11/182
2018/0151281 A1 * 5/2018 Khoshkava ..... G08B 6/00
2018/0242711 A1 * 8/2018 Poole ..... A46D 1/0276
2019/0374213 A1 * 12/2019 Goldsmith ..... A61B 17/3207

* cited by examiner

MULTIPOLE ELASTOMERIC MAGNET WITH MAGNETIC-FIELD SHUNT

This application claims the benefit of provisional patent application No. 62/515,904, filed Jun. 6, 2017, which is hereby incorporated by reference herein in its entirety.

FIELD

This relates generally to magnets, and, more particularly, to magnets formed from magnetic particles in polymers such as molded elastomers.

BACKGROUND

Magnets may be used as closures in bags, as clasps in watch bands, and in other items where it is desirable to hold structures together. If care is not taken, magnetic structures may be overly rigid, may not provide desired performance during engagement and disengagement, may not be integrable into desired products, or may be bulky and weak.

SUMMARY

A multipole permanent magnet may be provided with a magnetic-field shunt. The multipole magnet and magnetic-field shunt may be used in forming clasps for wrist bands and closures for electronic devices, cases, enclosures, and other items.

The multipole permanent magnet may be formed from compression-molded elastomeric polymer with magnetic particles such as magnetically anisotropic rare-earth particle. A magnetic field may be applied to the magnet during molding to align the rare-earth particles. A matrix of electromagnets may be used to magnetize the magnet and thereby create a desired pattern of poles.

The magnetic-field shunt may be formed from magnetic members in a polymer binder or from magnetic particles in a polymer binder. The magnetic particles in the polymer binder may be ferrite particles or other magnetic particles. The polymer binder may be formed from an elastomeric material and may be integral with the elastomeric polymer of the multipole permanent magnet or separated from the elastomeric polymer of the multipole permanent magnet by a polymer separator layer.

Conductive particles may be formed in polymer such as the elastomeric polymer with the magnetic particles. The conductive particles may be configured to form electrical connector contacts and other signal paths.

DETAILED DESCRIPTION

Figure 1:
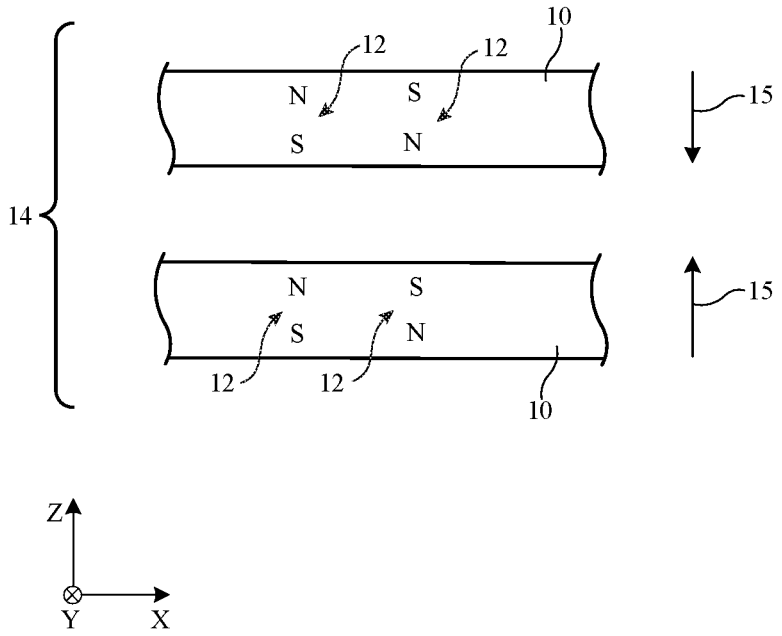
FIG. 1 is a schematic diagram of an illustrative magnetic system having a pair of magnets in accordance with an embodiment.

Magnets may be used in forming magnetic systems such as clasps for watchbands, may be used in forming closures for bags, cases, and other enclosures, and may be incorporated into other items in which magnetic attraction and/or repulsion between structures is desired. An illustrative magnetic system is shown in FIG. 1. As shown in FIG. 1, magnetic system 14 may include magnets 10. Each magnet 10 may have one or more permanent magnetic elements 12 (sometimes referred to as magnetic domains). The poles of elements 12 in magnets 10 may be arranged so that magnets 10 attract each other in directions 15. When desired, a user may separate magnets 10 by pulling magnets 10 apart.

In each magnet 10, elements 12 may be arranged so that the poles of different elements have potentially different orientations. For example, in a magnet with four elements 12, one element 12 may have its north pole pointing upwards (in the +Z direction of FIG. 1) and three elements 12 may have their north poles pointing downwards (e.g., in the −Z direction). The opposing magnet in a pair of magnets in a closure or clasp may have a corresponding set of magnet elements arranged in a complementary pattern so that magnets 16 are attracted to each other. Systems of the type shown in FIG. 1 in which magnets 10 each have multiple elements with potentially different pole arrangements (e.g., multiple different poles pointing in different respective directions) may sometimes be referred to as multipole magnet systems. Elements 12 of a multipole magnet such as magnet 10 can maintain their magnetization permanently and are therefore sometimes referred to as permanent magnetic elements. If desired, one of the magnets in a pair of multipole magnets 10 in system 14 may be replaced by a magnetic structure formed from a magnetic material (e.g., a bar of unmagnetized iron). In this type of arrangement, the magnetic material will be attracted to the permanent magnetic elements in the magnet. Arrangements in which system 14 is formed from a pair of multipole permanent magnets each having multiple permanent magnetic elements 12 are sometimes described herein as examples.

Figure 2:
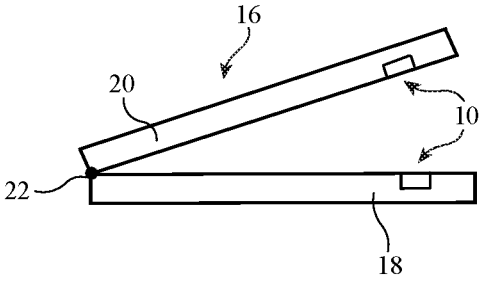
FIG. 2 is side view of an illustrative device with upper and lower housing portions that rotate about a hinge and that are coupled by magnets in accordance with an embodiment.

Magnetic system 14 may be incorporated into wearable items such as wristwatches, health bands, clothes, accessories such as earbuds, power cords, enclosures, electronic devices such as laptop computers, and/or other electronic equipment. An illustrative configuration in which magnets 10 of system 14 have been incorporated into a foldable portable electronic device is shown in FIG. 2. In this type of arrangement, item 16 may be an electronic device such as a laptop computer or other foldable device. As shown in FIG. 2, item 16 has a lower housing 18 (e.g., a housing with a keyboard, track pad, and/or portion of a display) and an upper housing 20 (e.g., a housing with a display, etc.). Magnets 10 may be mounted in housing portions 18 and 20 so that magnets 10 mate with each other when housing portion 20 is rotated into a closed position relative to housing portion 18 using hinge 22.

Figure 3:
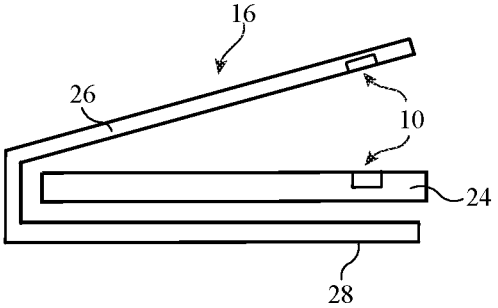
FIG. 3 is a cross-sectional view of an illustrative electronic device and associated cover with magnets in accordance with an embodiment.

In the example of FIG. 3, item 16 is a cover (case) for a tablet computer or other portable device such as device 24. Item 16 may have a lower portion such as portion 28 and an upper portion 26 that are coupled by a flexible portion of item 16 (e.g., a flexible fabric, a flexible polymer structure, a metal hinge, etc.). Magnets 10 may be incorporated into portion 26 of cover 16 and a mating portion of device 24 and/or magnets 10 may be mounted on mating regions in portions 26 and 28.

Figure 4:
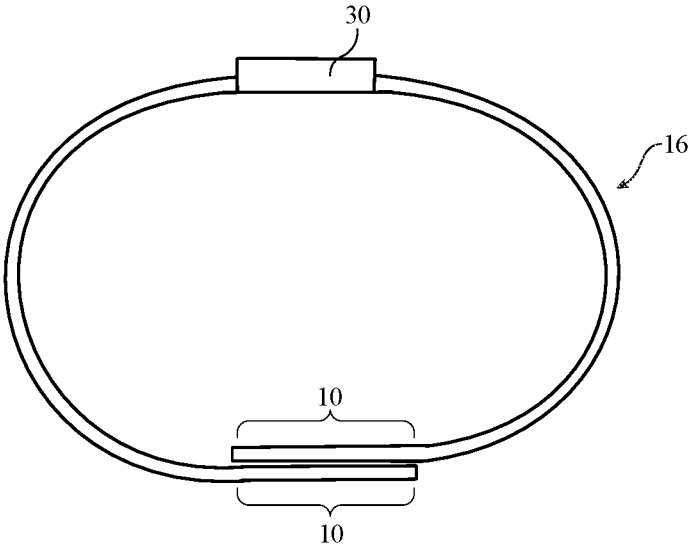
FIG. 4 is a side view of an illustrative watch having a watch band with magnets in accordance with an embodiment.

FIG. 4 shows how item 16 may be a wrist band such as a watch band for a watch. Item 16 may have a main watch unit such as unit 30 that is formed from metal, glass, etc. and that has a display, controller, battery, and other circuitry. Magnets 10 of FIG. 4 may be located on item 16 so that magnets 10 mate with each other when wrist band 16 is placed around the wrist of a user. Wrist band (strap) 16 may be formed from materials such as fabric, polymer, leather, metal, and other materials. Magnets 10 may be attached to one or more layers of these materials, may be embedded within the layer(s) of materials forming band 16, etc.

Figure 5:
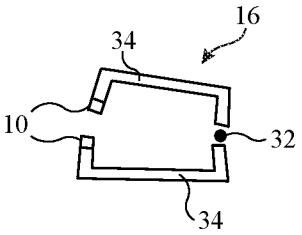
FIG. 5 is a cross-sectional side view of an enclosure having a hinge and having magnets in accordance with an embodiment.

FIG. 5 shows how item 16 may be an enclosure (e.g., a bag, case, cover, etc.) in which enclosure walls 34 can be rotated relative to each other about hinge 32 or a flexible portion of enclosure walls 32. Magnets 10 may form a closure for item 16.

Figure 6:
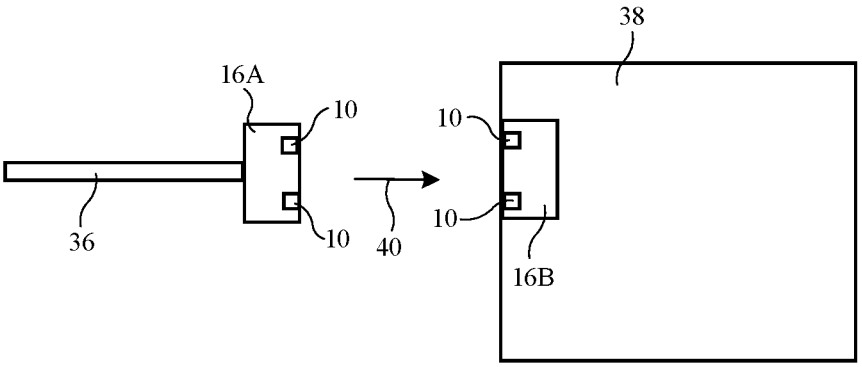
FIG. 6 is a top view of an illustrative electronic device having an electrical connector with magnets and a corresponding cable having a mating electrical connector with magnets in accordance with an embodiment.

FIG. 6 shows how item 16 may include a connector system. For example, item 16A may be an electrical connector at the end of cable 36. Item 16B may be a corresponding electrical connector in electronic device 38. Magnets 10 may be incorporated into items 16A and 16B so that item 16A mates with item 16B and is held in place on item 16B magnetically after item 16A is moved in direction 40 to engage with item 16B. Item 16A may include signal paths for forming contacts and carrying data signals and/or power signals.

Magnets 10 may be formed by molding. For example, magnets 10 may be formed by compression molding magnetic particles such as neodymium particles or other rare earth magnetic particles in a polymer. The polymer may be, for example, an elastomeric polymer such as silicone or urethane. Illustrative configurations in which silicone is used in forming magnets 10 may sometimes be described herein as examples. In general, any suitable polymers (e.g., flexible polymers, polymers formed from a mixture of one or more polymeric substances, etc.) may be used in forming magnets 10.

Figure 7:
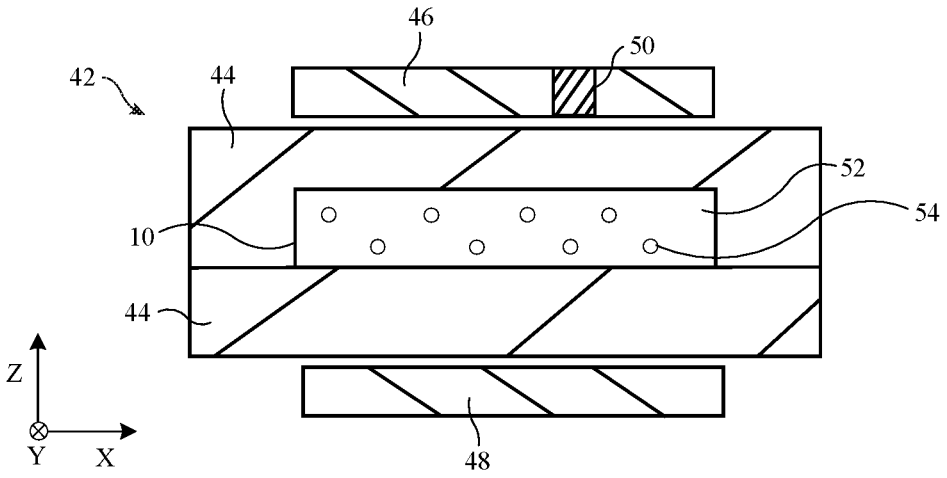
FIG. 7 is a cross-sectional side view of an illustrative magnet being formed by molding polymer material and magnetic particles, applying a magnetic field to orient the magnetic particles, and applying a pattern of magnetic fields to create a desired pattern of poles in the magnet in accordance with an embodiment.

An illustrative compression molding tool for forming magnets 10 is shown in FIG. 7. Magnet 10 may be compression molded in mold 44 of molding tool 42 under heat and pressure. As shown in FIG. 7, magnet 10 may be formed from magnetic particles 54 (e.g., neodymium particles or other rare earth magnetic particles) embedded in a polymer such as elastomeric polymer 52. During molding, elastomeric polymer 52 may be cured (e.g., from an initial uncured liquid state to a final cured solid state). Magnetic fields may be applied by electromagnets 46 and 48 while polymer 52 has a sufficiently low viscosity to allow particles 54 to be reoriented.

Particles 54 preferably are magnetically anisotropic, so the poles of particles 54 become aligned along a common dimension when electromagnets 46 and 48 apply a magnetic field to magnet 10 (e.g., a magnetic field aligned along the Z dimension). After the particles 54 are aligned, curing can be completed so that polymer 52 becomes sufficiently solid to hold particles 54 in their desired orientation. Magnets 46 and 48 (or other suitable magnets) may then be used to magnetize particles 54 to form permanent magnetic elements 12 in a desired pattern. To form a multipole magnet, a pattern of magnetizing magnetic fields may be applied to magnets 10 (e.g., using matrices of individually adjustable electromagnets in electromagnets 46 and 48, as illustrated by individually adjustable electromagnet 50).

Figure 8:
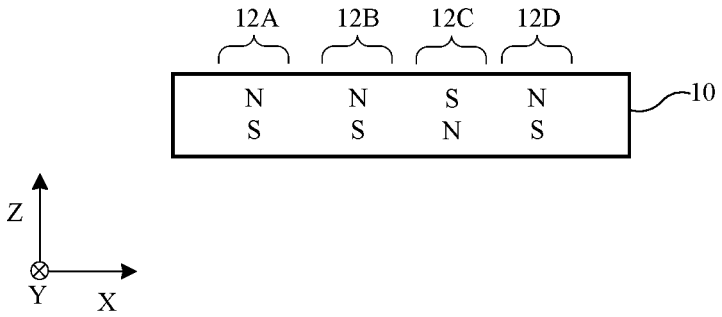
FIG. 8 is a cross-sectional side view of an illustrative multipole magnet in accordance with an embodiment.

FIG. 8 is a cross-sectional side view of an illustrative multipole magnet following compression molding of an elastomeric polymer with embedded magnetically anisotropic rare earth particles, magnetic alignment of the particles, and magnetization using a matrix of electromagnets to form a desired pattern of permanent magnetic elements. In the example of FIG. 8, elements 12A, 12B, and 12D have their north poles pointing upwards in direction Z and have their south poles pointing downwards in direction −Z, whereas element 12C has its north pole pointing in the −Z direction and its south pole pointing in the Z direction. Other patterns of magnetic polarity may be used in forming magnetic elements for magnet 10, if desired.

By forming multiple magnetic poles in magnet 10, magnet 10 may exhibit desired alignment and attraction properties. Consider, as an example, item 16 of FIG. 9. Illustrative item 16 of FIG. 9 may be, for example, a watch band. Magnet 10 may be formed so that rows of elements 12 have alternating polarity and so that the edges of each row have magnetic polarities that help align the two mating halves of the band. For example, odd rows R1 and R3 may have central portions with exposed south poles, whereas alternating even rows R2 and R4 may have central portions with exposed north poles. By alternating polarity in alternating rows, slippage along the length of the band may be minimized, but other patterns of magnetic elements may be used, if desired.

Figure 9:
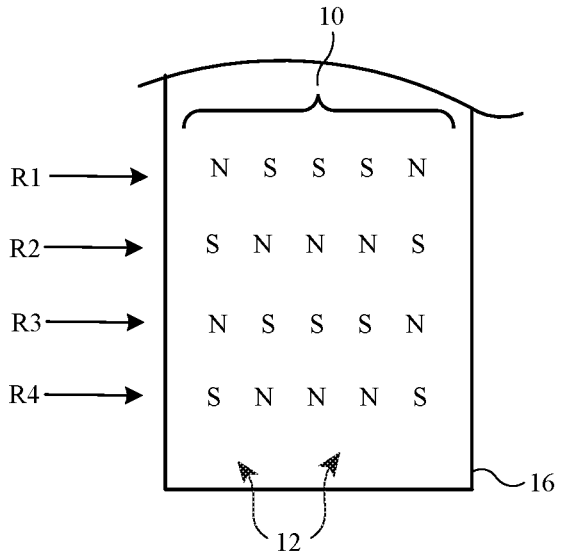
FIG. 9 is a top view of a portion of a structure such as a watch band having a multipole magnetic in accordance with an embodiment.

The flanking magnetic elements at the edges of each row in the example of FIG. 9 may have a polarity that is opposite to the polarity of the elements in the center of that row. For example, the edges of row R1 may have elements 12 with exposed north poles, whereas the central element in row R1 have exposed south poles. The mating magnet in band 16 in this illustrative scenario has edges with elements 12 having exposed south poles and a central region with exposed north poles. This type of pattern helps avoid lateral slippage of the band halves (e.g., slippage along the lengths of the rows is minimized). In general, any suitable multipole magnetic pattern may be used in forming magnets 10 and item 16. The configuration of FIG. 9 is merely illustrative.

In some configurations, magnets 10 may have integrated magnetic-field shunts. Shunts may be formed from magnetic particles such as ferrite particles in a polymer binder (e.g., an elastomeric polymer such as silicone). Shunts that are formed from magnetic members such as ferrite members may also be used.

Figure 10:
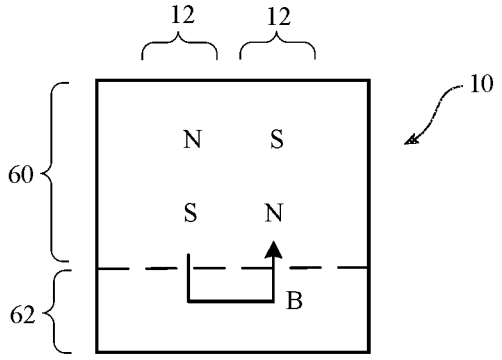
FIG. 10 is a cross-sectional side view of an illustrative magnet with an integral magnetic-field shunt in accordance with an embodiment.

Consider, as an example, magnet 10 of FIG. 10. As shown in FIG. 10, magnet 10 may have one or more permanent magnet portions such as multipole permanent magnet layer 60. Layer 60, which may sometimes be referred to as a permanent magnetic layer or layer of permanent magnetic elements, may have multiple magnetic elements 12 formed by compression molding, magnetic alignment of magnetically anisotropic rare-earth particles, and magnetization of the elastomeric material with embedded rare earth magnetic particles, as described in connection with FIGS. 7 and 8. Magnetic 10 may also have one or more magnetic-field shunt portions such as magnetic-field shunt layer 62. Shunt layer 62 may be formed from ferrite particles embedded in a polymer binder such as a compression molded silicone layer or other magnetic structures and may serve to shunt magnetic field B between adjacent poles of opposite polarity (e.g., magnetic field B may be shunted through layer 62 from the south pole in the leftmost element 12 of FIG. 10 to the north pole in the rightmost element 12 of FIG. 10 rather than being emitted out of the lower surface of magnet 10). The presence of shunt layer 62 may improve the performance of magnet 10 by concentrating magnetic fields.

Layers 60 and 62 may be formed in one or more molding operations and/or may be fabricated using other techniques (lamination, etc.).

Figure 11:
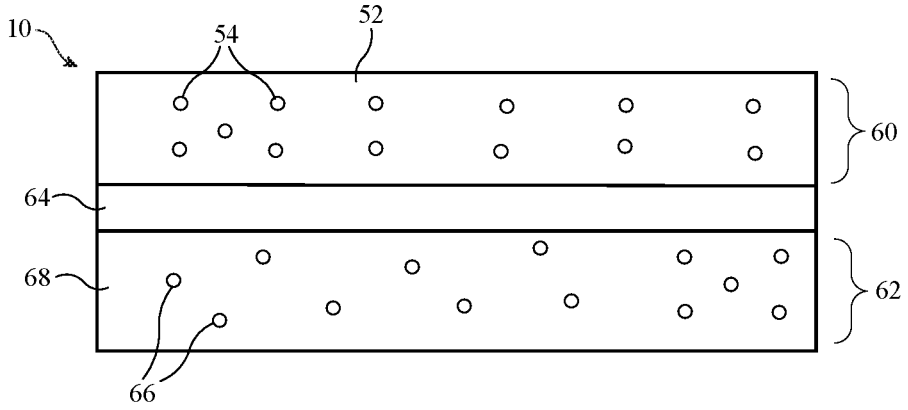
FIG. 11 is a cross-sectional side view of an illustrative magnet with an internal separation layer separating a layer of permanent magnetic elements from a magnetic-field shunt layer in accordance with an embodiment.

As shown in the illustrative configuration of FIG. 11, layer 62 may be formed from magnetic particles 66 (e.g., non-rare-earth magnetic particles such as ferrite particles) embedded in polymer binder 68 (e.g., silicone or other elastomeric material). Layer 64 (e.g., a flexible polymer layer such as a layer of silicone or other elastomeric polymer that serves as a separator layer) may be placed on top of liquid polymer precursor material for polymer 68 in mold tool 42 (FIG. 7). Polymer 52 with embedded magnetic particles 54 may then be introduced in tool 42 on top of layer 64. Due to the presence of layer 64, magnetic particles 54 will not migrate to layer 62 and magnetic particles 66 will not migrate to layer 60 during compression molding operations to form magnet 10 in tool 42.

Figure 12:
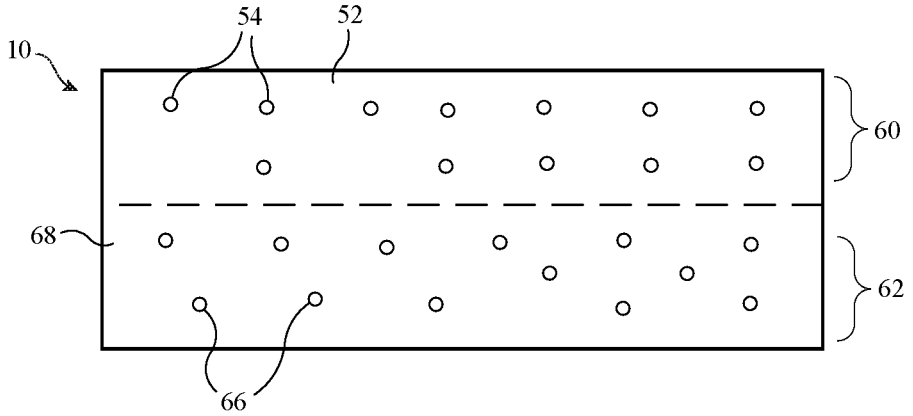
FIG. 12 is a cross-sectional side view of an illustrative magnet with a layer of permanent magnet elements and a magnetic-field shunt layer in accordance with an embodiment.

In the illustrative configuration of FIG. 12, layer 64 has been omitted. In this type of arrangement, magnetic particles 66 and magnetic particles 54 may be incorporated into a common material (e.g., binder 52 and binder 68 may both be silicone or other elastomeric material). In the mold cavity in tool 42, magnetic particles 66 may settle to the bottom of magnet 10, so that layer 60 contains primarily magnetic particles 54 and so that layer 62 contains primarily magnetic particles 66, thereby forming layers 60 and 62 as integral sublayers in a common layer of elastomeric material for magnet 10.

Figure 13:
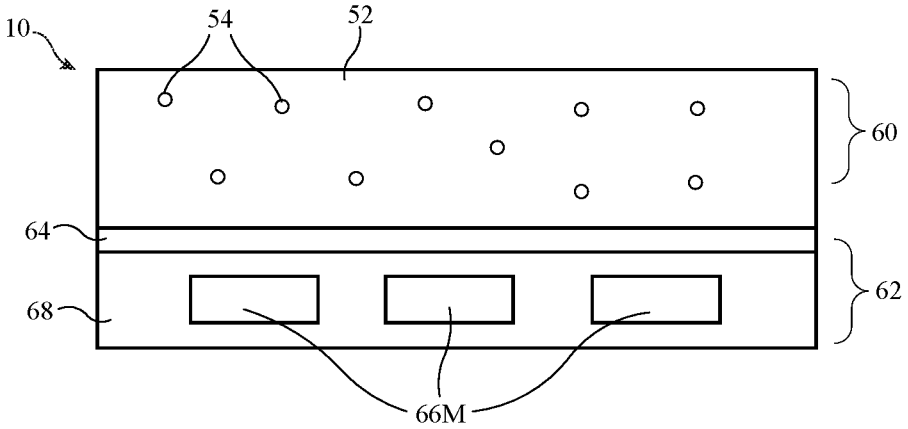
FIG. 13 is a cross-sectional side view of an illustrative magnet with a layer of permanent magnet elements and a magnetic-field shunt layer formed from discrete members of magnetic material in accordance with an embodiment.

FIG. 13 is a cross-sectional side view of magnet 10 in an illustrative configuration in which layer 62 contains multiple individual magnetic members 66M embedded in elastomeric polymer 68. Magnetic members 66M serve as shunts and thereby form a magnetic-field shunt layer. Members 66M may be formed from ferrite bars or other pieces of magnetic material. Layer 64 may optionally be used to separate polymer 68 and shunt members 66M from layer 60 during compression molding of layers 62, 64, and 60 in tool 42. Gaps may be formed between adjacent members 66M to ensure that magnet 10 is flexible.

If desired, other arrangements may be used for forming flexible magnets 10 (e.g., by laminating a flexible multipole permanent magnet layer with a flexible shunt layer after forming these parts separately). The configurations of FIGS. 11, 12, and 13 are illustrative.

Figure 14:
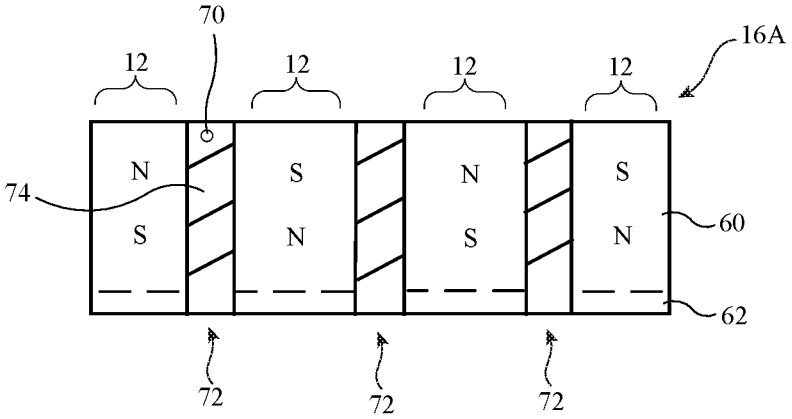
FIG. 14 is a cross-sectional side view of an illustrative connector having molded magnets and conductive regions forming signal paths in accordance with an embodiment.

In some arrangements, conductive particles are incorporated into compression molded elastomeric structures in addition to or instead of magnetic particles. Consider, as an example, illustrative electrical connector 16A of FIG. 14. As shown in FIG. 14, connector 16A may include conductive paths such as contacts 72. Contacts 72 may be used to carry signals from wires in cable 36 of FIG. 6 to mating contacts in electrical connector 16B of device 38 when connectors 16A and 16B are coupled together. Contacts 72 may be formed from conductive particles 70 embedded in polymer 74. Conductive particles 70 may be metal particles such as copper particles, nickel particles, or particles in conductive powders formed from other materials (e.g., cobalt, beryllium, titanium, tantalum, tungsten, etc.). Polymer 74 may be an elastomeric polymer such as silicone and may be the same as the material used in forming polymer binder 52 and/or 68 or may be a different polymeric material. To help attract connector 16A to connector 16B, connector 16A may be provided with a multipole magnet formed from flexible permanent magnetic elements 12 having poles arranged in a complementary pattern to the arrangement of magnetic element poles in a mating multipole magnet in connector 16B. Shunt layer 62 may optionally be included in connector adjacent to layer 60.

Figure 15:
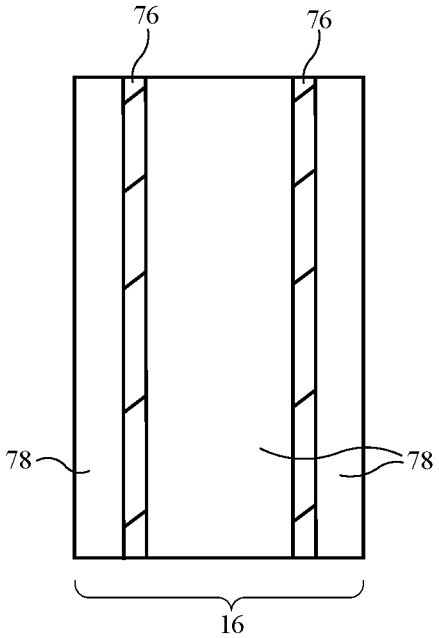
FIG. 15 is a top view of an illustrative elastomeric layer having integral conductive regions in accordance with an embodiment.

As shown in the top view of illustrative item 16 of FIG. 15, conductive signal paths such as paths 76 may be formed in item 16. Paths 76 may be formed from conductive particles 70 (FIG. 14) embedded in polymer 74 (FIG. 14). Other portions of item 16 of FIG. 15 may be formed from flexible polymer such as polymer 78 (e.g., an elastomeric polymer such as silicone, etc.). Polymer 78 and the polymer of paths 76 may be formed from the same material or different materials. During molding operations (e.g., compression molding of polymer 78 and the polymer of paths 76 or other suitable molding operations), desired layouts may be implemented for paths 76 (e.g., to route power signals between electrical components in item 16, to form data lines that carry analog and/or digital signals in item 16, to form a ground structure, to form an electromagnetic interference shield, etc.). Item 16 of FIG. 15 may be, as an example, a wrist band for a watch, a stand-alone wrist band device such as a health band, etc.

The foregoing is merely illustrative and various modifications can be made to the described embodiments. The foregoing embodiments may be implemented individually or in any combination.

What is claimed is:

1. A multipole magnet, comprising:

an elastomeric polymer;

magnetically anisotropic rare-earth magnetic particles in the elastomeric polymer configured to form multiple permanent magnet elements; and a magnetic-field shunt.

2. The multipole magnet defined in claim 1 wherein the magnetic-field shunt comprises magnetic particles in an elastomer.

3. The multipole magnet defined in claim 1 wherein the magnetic particles of the magnetic-field shunt comprise ferrite particles.

4. The multipole magnet defined in claim 1 wherein the magnetic-field shunt comprises multiple magnetic members in a binder.

5. The multipole magnet defined in claim 4 wherein the binder comprises an elastomeric material.

6. The multipole magnet defined in claim 4 wherein the elastomeric polymer is silicone and wherein the binder is silicone.

7. The multipole magnet defined in claim 1 wherein the elastomeric polymer is configured to form a layer in an item selected from the group consisting of: a wrist band and an electronic device cover.

8. The multipole magnet defined in claim 1 wherein the elastomeric polymer is configured to form a closure in an item with a hinge.

9. The multipole magnet defined in claim 1 wherein the elastomeric polymer includes conductive particles that form signal paths.

10. A wrist band, comprising:

a first elastomeric layer containing first magnetic particles configured to form a multipole permanent magnet; and a second elastomeric layer containing second magnetic particles configured to form a magnetic-field shunt layer for the multipole permanent magnet.

11. The wrist band defined in claim 10 wherein the first magnetic particles are rare-earth particles.

12. The wrist band defined in claim 11 wherein the second magnetic particles are ferrite particles.

13. The wrist band defined in claim 10 wherein the first elastomeric layer comprises silicone, the second elastomeric layer comprises silicone, and the first magnetic particles are magnetically anisotropic rare-earth particles.

14. The wrist band defined in claim 10 further comprising conductive particles in the first elastomeric layer that are configured to form signal paths through the first elastomeric layer.

15. The wrist band defined in claim 10 further comprising a polymer separator layer between the first and second elastomeric layers.

16. The wrist band defined in claim 10 wherein the first and second elastomeric layers comprises integral sublayers in a common elastomeric wrist band member.

17. Apparatus, comprising:

a compression-molded multipole rare-earth magnet having magnetically anisotropic rare-earth magnetic particles in an elastomeric polymer; and a magnetic-field shunt that shunts magnetic fields from the compression-molded multipole rare-earth magnet.

18. The apparatus defined in claim 17 wherein the magnetic-field shunt comprises magnetic members in a polymer binder and wherein the magnetic members are separated by gaps that allow the magnetic-field shunt to flex.

19. The apparatus defined in claim 17 wherein the magnetic-field shunt comprises magnetic particles in a polymer binder.

20. The apparatus defined in claim 17 further comprising conductive particles in a polymer that form electrical connector contacts.

* * * * *